US007246587B2

(12) United States Patent
Evans et al.

(10) Patent No.: US 7,246,587 B2
(45) Date of Patent: Jul. 24, 2007

(54) DEACTIVATING ELEMENT FOR A VALVE TRAIN OF AN INTERNAL COMBUSTION ENGINE

(75) Inventors: Matthew Evans, Warren, MI (US); Peter Sailer, Erlangen (DE)

(73) Assignee: Schaeffler KG, Herzogenaurach (DE)

( * ) Notice: Subject to any disclaimer, the term of this patent is extended or adjusted under 35 U.S.C. 154(b) by 0 days.

(21) Appl. No.: 11/480,157

(22) Filed: Jun. 30, 2006

(65) Prior Publication Data

US 2007/0000459 A1 Jan. 4, 2007

(30) Foreign Application Priority Data

Jul. 1, 2005 (DE) ..... 10 2005 030 718

(51) Int. Cl.
*F01L 1/14* (2006.01)

(52) U.S. Cl. ..... 123/90.52; 123/90.45; 123/90.48

(58) Field of Classification Search ..... 123/90.39, 123/90.44, 90.45, 90.48, 90.52, 90.55
See application file for complete search history.

(56) References Cited

U.S. PATENT DOCUMENTS 7,146,951 B2 * 12/2006 Sailer et al. ..... 123/90.45

FOREIGN PATENT DOCUMENTS

| | | |
|---|---|---|
| DE | 196 04 866 A1 | 8/1997 |
| DE | 198 04 952 A1 | 8/1999 |
| DE | 695 13 165 T2 | 6/2000 |
| DE | 601 11 117 T2 | 3/2001 |

* cited by examiner

*Primary Examiner*—Ching Chang
(74) *Attorney, Agent, or Firm*—Charles A. Muserlian

(57) ABSTRACT

The invention proposes a deactivating element (1) for a valve train of an internal combustion engine. The deactivating element (1) comprises a housing (2) and an inner element (4) that is axially displaceable in the bore (3) of the housing (2). According to the invention, the pistons (7) arranged in the inner element (4) for coupling into an annular groove (12) in the housing (2) possess two flattened regions (10, 15) arranged diametrically opposite each other in axial direction of the deactivating element (1). The height of the annular groove (12) is reduced by a measure of a height of the second, additional flattened region (15). Due to the reduction of height of the annular groove (12), its volume is also reduced. This results in advantages activation and deactivation times.

9 Claims, 1 Drawing Sheet

DEACTIVATING ELEMENT FOR A VALVE TRAIN OF AN INTERNAL COMBUSTION ENGINE

FIELD OF THE INVENTION

The invention concerns a deactivating element for a valve train of an internal combustion engine, said deactivating element comprising a housing and an inner element that is axially displaceable in a bore of the housing and is biased through a lost motion spring in a direction leading out of the bore, at least one piston extending in a radial bore of the inner element, a first flattened region starting from a radially outer front end of the piston being arranged on a first axial side of the piston, for coupling the inner element to the housing in a relative position, said first flattened region can be displaced partially onto a flat entraining surface of an annular groove of the bore of the housing, at least one passage extending through the housing for supplying hydraulic medium to the annular groove, and the piston being adapted to be re-displaced into the radial bore of the inner element by the hydraulic medium.

BACKGROUND OF THE INVENTION

A deactivating element of a generic type disclosed in DE 102 04 672 A1 is configured as a roller tappet. Coupling is achieved in this roller tappet by two pistons situated diametrically opposite each other in the inner element of the roller tappet. Each of these pistons comprises a flattened portion starting from its radially outer front end and extending on an underside of the piston. In the coupled state, these flattened portions cooperate with a counter annular surface of an annular groove provided in a bore of the housing of this prior art deactivating element.

As discussed in sufficient detail in said prior art document, two locking rings are provided for adjusting the coupling lash (besides this, a similar lash adjustment, but only with one ring, is disclosed in DE 101 46 131 A1). A constant-thickness lower locking ring and a variable-thickness upper locking ring are kept ready. The aforesaid annular groove must have a minimum height corresponding to a height of the piston in the coupled region (flattened portion), plus a coupling lash of, for example, 0.1 mm, plus the thickness of the thickest upper locking ring that may have to be mated thereto.

An annular space situated in front of the piston and defined by the annular groove serves as a pressure chamber for the hydraulic medium. Particularly in the case of deactivating elements with a very short overall length, a leak gap situated between the inner element and the housing and communicating with the aforesaid pressure chamber has only an inadequate height, so that excessive losses of hydraulic medium through this gap must be taken into account. Besides this, due to the relatively high annular space, an unnecessarily large quantity of hydraulic medium has to be accumulated for displacing the pistons. This has an unfavorable effect on the speed of activation and deactivation.

OBJECTS OF THE INVENTION

It is an object of the invention to provide a deactivating element of the pre-cited type in which the cited drawbacks are eliminated.

This and other objects and advantages of the invention will become obvious from the following detailed description.

SUMMARY OF THE INVENTION

The invention achieves the above objects by the fact that a second flattened region starting from the axially outer front end of the piston and situated opposite the first flattened region is arranged on a second axial side of the piston opposite the first axial side of the piston, and a height of the annular groove in the housing is reduced by a measure not larger than a height of the second flattened region.

The scope of protection of the invention applies to all types of deactivating valve train components. Thus, in addition to deactivating or, where appropriate, also switchable roller or sliding tappets, cup tappets, support tappets etc. are also covered by the scope of the invention.

With the measures provided by the invention, the initially described drawbacks are eliminated. The annular groove is minimized approximately by a measure corresponding to the height of the second flattened region. This inevitably results in a higher leak gap between the housing and the inner element so that hydraulic medium losses are minimized. Due to the smaller volume of the pressure chamber (annular groove), shorter switching times can be realized.

The scope of protection of the invention likewise applies to solutions in which the at least one piston for coupling is arranged in the housing and can be displaced radially inwards onto an annular groove of the inner element.

The at least one piston can be made by machining, but also without chip removal. The radially outer front end preferably has a convex shape.

Where appropriate, the variable-thickness locking rings for defining the relative position can be dispensed with. In this case, a constant coupling lash of, for example, 0.1 mm (see also DE 102 04 672 A1) can be achieved for a large number of deactivating elements by implementing correspondingly complex mating measures. To assure that the flattened region of the at least one piston is aligned to the axial direction of the deactivating element, it is appropriate to provide anti-rotation measures for the piston in the radial bore of the inner element. In this connection, measures such as key and slot connections or other similar solutions as described in DE 102 04 672 A1, with which a person skilled in the art is familiar, can be advantageously used.

Furthermore, it is advantageous to configure the inner element for free rotation relative to the bore of the housing. In this way, separate anti-rotation measures for the inner element can be omitted.

According to an alternative feature of the invention, the bore comprising the at least one piston in the inner element may be offset in peripheral direction by approximately 90° from the passage provided for hydraulic medium in the housing. In this case, the use of an anti-rotation device is advantageous, but a self-centering is also possible. In this embodiment, particularly if two pistons are arranged diametrically opposite each other, the oil paths to the two pistons always have the same length.

Although a particularly advantageous embodiment of the invention provides precisely two diametrically opposed pistons for coupling, it is also conceivable to use a plurality of peripherally distributed, radially extending pistons, or only one piston for coupling.

A displacement of the pistons when hydraulic medium is cut-off (coupling) can advantageously be effected through the force of at least one compression spring. Alternatively, it is also possible to achieve reverse displacement of the pistons by hydraulic medium pressure or with the help of another servo means.

The invention will now be described more closely with reference to the appended drawing.

BRIEF DESCRIPTION OF THE INVENTION

DETAILED DESCRIPTION OF THE DRAWINGS

Figure 1:
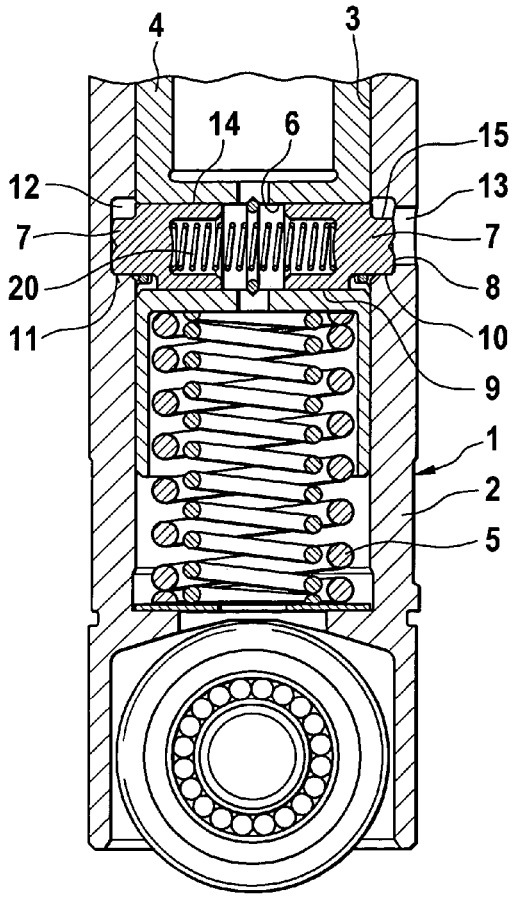
FIG. 1 shows a longitudinal section through a deactivating element of the invention.

FIG. 1 discloses a deactivating element 1, configured as a roller tappet, for a valve train of an internal combustion engine. The deactivating element 1 cooperates at one end with a lifting cam of a bottom camshaft. At the other end, (see FIG. 2), it acts through a hydraulic lash adjuster (optional), not referenced, on a tappet pushrod.

The deactivating element 1 comprises a pot-shaped housing 2. An inner element 4 is installed for axial displacement in a bore 3 of the housing 2. A lost motion spring 5 (in the present case, a spring assembly) biases the inner element 4 in a direction leading out of the bore 3 toward the tappet pushrod.

The inner element 4 comprises two pistons 7 that are situated diametrically opposite each other for coupling. These pistons 7 are biased radially outwards through the force of at least one compression spring 20. A reverse displacement of the pistons 7 into their radial bore 6 for effecting uncoupling is realized through hydraulic medium. This is conveyed through a short passage 13 directly to an annular groove 12 of the bore 3 of the housing 2. The annular groove 12 thus forms a pressure chamber for the hydraulic medium.

FIG. 1 discloses the coupled state of the deactivating element 1. In this state, the first flattened region 10, that starts from a front end 8 of each piston 7 and is arranged on a first axial side 9 of each of the two diametrically opposed pistons 7, extends on an entraining surface 11 of the annular groove 12.

Figure 3:
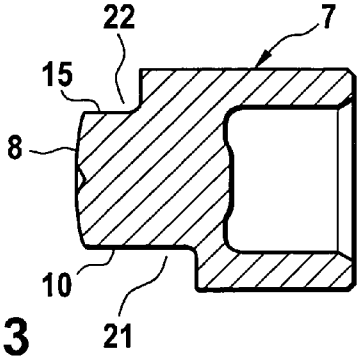
FIG. 3 shows a detail of the coupling piston.
Figure 4:
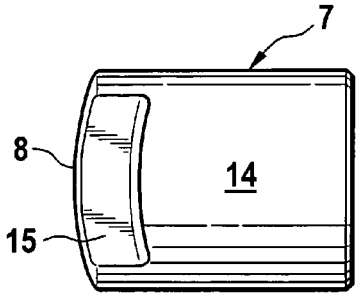
FIG. 4 is a top view of said coupling piston.

As shown in FIGS. 1 and 3, the pistons 7 have a second flattened region 15 that likewise starts from the front end 8. This second flattened region 15 is situated opposite the first flattened region 10 in axial direction of the deactivating element 1. In this way, the flattened regions 10, 15 of the pistons 7 form recesses 21, 22 having a stepped geometry.

Figure 2:
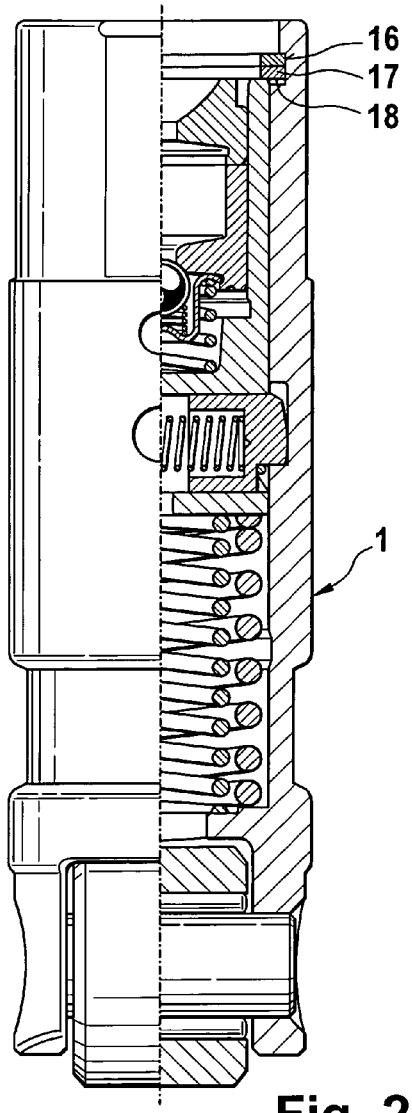
FIG. 2 shows a prior art deactivating element.

A closer look at FIG. 2, that shows a prior art roller tappet as also described in DE 102 04 672 A1 and DE 102 04 673 A1, makes it clear that the annular groove of the prior art has a clearly larger height than the annular groove of the deactivating element 1 of the present invention (for drawbacks, see introductory part of the description).

According to FIG. 1, the height of the annular groove 12 has been decreased. The reduction of height correlates with a height of the second flattened region 15 of the piston 7. In this way, a sealing length of an annular gap between the inner element 4 and the housing 2 is enlarged. This is particularly advantageous in deactivating elements 1 with a very short overall length. Hydraulic medium losses out of the pressure chamber within the annular groove 12 are minimized. At the same time, the volume of the aforesaid annular space is reduced so that shorter reaction times of the piston 7 can be achieved.

Although FIG. 2 shows a prior art deactivating element 1, the means (16, 17, 18) shown in its upper region for adjusting the coupling lash is also a component part of the deactivating element 1 of FIG. 1. As already sufficiently described in DE 102 04 672 A1, at least one variable-thickness locking ring 17 is kept ready for mounting. The coupling lash is thus adjusted in such a way that it is substantially constant with a value of, for example, 0.1 mm for a large series of deactivating elements 1.

The invention claimed is:

1. A deactivating element for a valve train of an internal combustion engine, said deactivating element comprising a housing and an inner element that is axially displaceable in a bore of the housing and is biased through a lost motion spring in a direction leading out of the bore, at least one piston extending in a radial bore of the inner element, a first flattened region starting from a radially outer front end of the piston being arranged on a first axial side of the piston, for coupling the inner element to the housing in a relative position, said first flattened region can be displaced partially onto a flat entraining surface of an annular groove of the bore of the housing, at least one passage extending through the housing for supplying hydraulic medium to the annular groove, and the piston being adapted to be re-displaced into the radial bore of the inner element by the hydraulic medium, wherein a second flattened region starting from the axially outer front end of the piston and situated opposite the first flattened region is arranged on a second axial side of the piston opposite the first axial side of the piston, and a height of the annular groove in the housing is reduced by a measure not larger than a height of the second flattened region.

2. A deactivating element of claim 1, wherein the switching element is a cam follower in form of a roller or a sliding tappet for a tappet pushrod drive.

3. A deactivating element of claim 2, wherein at least one variable-thickness locking ring kept ready during mounting is installed in a pushrod-side annular groove of the bore of the housing for defining the relative position.

4. A deactivating element of claim 1, wherein the piston in the radial bore of the inner element is secured against rotation.

5. A deactivating element of claim 1, wherein the inner element in the bore of the housing is arranged for free rotation.

6. A deactivating element of claim 1, wherein two pistons are arranged diametrically opposite each other in the radial bore of the inner element and can be displaced radially outwards through the force of one of a servo means such as at least one compression spring or by hydraulic medium pressure.

7. A deactivating element of claim 1, wherein the recesses formed on the piston through the flattened regions are asymmetric to each other.

8. A deactivating element of claim 1, wherein the passage for hydraulic medium extends at a level of the annular groove directly radially through the housing.

9. A deactivating element of claim 1, wherein, as viewed in peripheral direction, the radial bore in the inner element is offset at an angle of 90°±15° to the passage.

* * * * *